United States Patent [19]

Stempfhuber

[11] Patent Number: 4,576,396

[45] Date of Patent: Mar. 18, 1986

[54] ELECTRONIC SKI-BINDING

[75] Inventor: Lorenz Stempfhuber, Oberau, Fed. Rep. of Germany

[73] Assignee: Marker International Company, Salt Lake City, Utah

[21] Appl. No.: 708,273

[22] Filed: Mar. 5, 1985

[30] Foreign Application Priority Data

Mar. 7, 1984 [DE] Fed. Rep. of Germany ..... 3408335

[51] Int. Cl.[4] ..... A63C 9/08

[52] U.S. Cl. ..... 280/612; 307/116

[58] Field of Search ..... 307/116, 127, 130, 131; 280/611, 612

[56] References Cited

U.S. PATENT DOCUMENTS 4,140,331 2/1979 Salomon ..... 280/612
4,159,124 6/1979 Salomon ..... 280/612
4,402,524 9/1983 D'Antonio et al. ..... 280/612

FOREIGN PATENT DOCUMENTS 3132465 9/1983 Fed. Rep. of Germany .

*Primary Examiner*—Joseph F. Peters, Jr.
*Assistant Examiner*—Michael Mar
*Attorney, Agent, or Firm*—D. Peter Hochberg

[57] ABSTRACT

An electronic ski binding incorporating an induction coil and a magnet movable relative to the coil to induce signals in the coil when a skier steps into the binding, to generate control signals to an electronic switch to connect an energy source to an electrical load.

10 Claims, 10 Drawing Figures

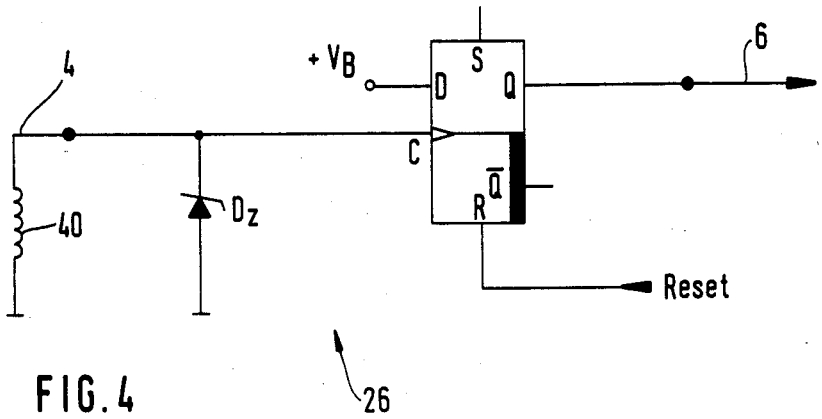
FIG. 4
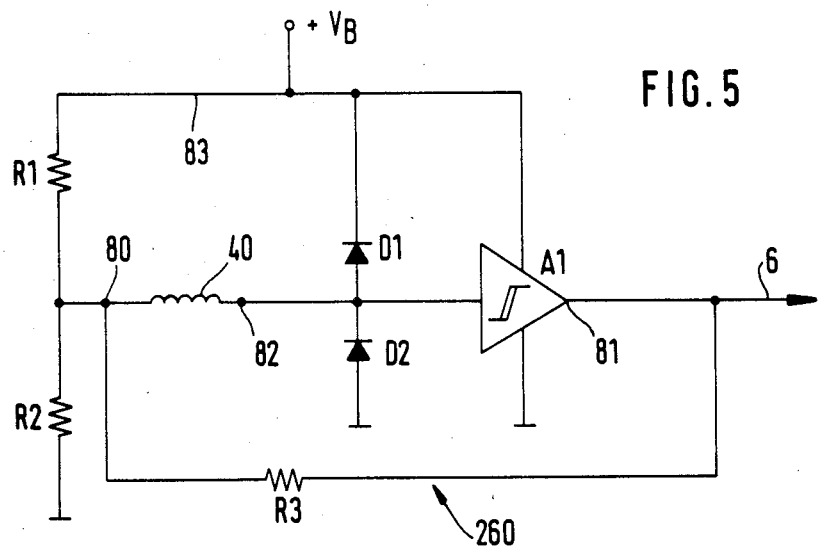
FIG. 5
FIG. 6
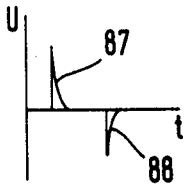
FIG. 7
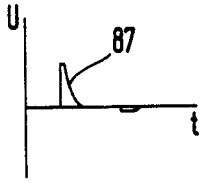

ELECTRONIC SKI-BINDING

The invention relates to an electronic ski-binding and specifically to an apparatus for generating an electrical control signal for an electric switch which is used for providing a connection between a battery and a load represented by the electronic part of the ski-binding.

Electronic ski-bindings are already known. The electric power required to operate the electronic ski-bindings is typically supplied by batteries. The batteries are not switched on all the time and are not in a condition where they have to supply a large current. It is therefore already known to provide a switch for making a connection between the battery and the electric part of an electronic ski-binding at the time the ski is being used. The easiest way to provide for that connection is to manually operate the switch. However, it is much more desirable to provide for an automatic connection at the time the skier steps with his ski-boot into the electronic ski-binding.

Quite a variety of possibilities are known to arrange for an automatic connection between the battery and the load represented by the electronic ski-binding. According to U.S. Pat. No. 4,140,331 a mechanically closable switch is provided which is actuated when the skier steps into the binding. Another embodiment of said U.S. patent suggests a magnetic switch which is fixedly mounted in the binding. A magnet is arranged on the ski-boot and as soon as the magnet comes closer to the magnetic switch, the magnetic switch is actuated to provide for the desired connection between the battery and the load. A disadvantage of the mechanical operation is the fact that the switch is relatively complicated and subject to failures. The switch has a tendency to bounce, i.e. it will open and close during short intervals if vibrations and abrupt movements occur. Also, the contact surfaces are subject to oxidation. In the case where movable magnetic means are used, specifically designed ski-boots are necessary for insertion into the ski-bindings.

From another ski-binding it is known to arrange between the battery and the load, an electronic switch. This electronic switch is adapted to be actuated by variable impedence means or by means of a piezo-electric element. It is advantageous that this switch for all practical purposes does not need any movable components. However, problems of stability occur because of temperature effects over time. Also, piezo-electric elements are sensitive with respect to moisture, and because of the brittleness of the piezo-electric elements, the applied force has to be limited with the consequence that additional mechanical means are necessary.

It is an object of the present invention to provide an apparatus for generating an electric control signal for an electronic switch such that the switch-on and switch-off operation of the battery is carried out with the utmost safety.

Another object of the present invention is to provide control means with which relatively simple components may be used.

Another object of the invention is to provide for an easy approach when integrating these components in sporting goods, in general, and in ski-bindings, in particular.

Another object of the invention is to provide means for generating control signals which are not affected by the environment.

According to the preferred form of the invention, means are provided for generating a control signal for an electronic switch. This generating means is adapted to cause a change of the magnetic flux in a pick-up coil as soon as a step-in operation into an electronic ski-binding occurs. The change of the magnetic flux creates an induction voltage which is used for controlling the electronic switch. The invention can be used not only for a ski-binding, but also for other appropriate sporting goods.

In accordance with a preferred embodiment of the invention, a magnetic circuit comprising a core and a yoke is provided. The magnetic circuit is opened and/or closed with high speed so as to generate a high voltage of induction in the pick-up coil. It is preferred that the movable part of the magnetic circuit, for instance the yoke, be mounted in such a manner on the movable part of the binding that the force of attraction caused by a permanent magnet of the magnetic circuit is used for the final acceleration of the movable part and is consequently exploited for the generation of a large induction peak voltage.

Another preferred embodiment of the invention provides that the movable part of the magnetic circuit is resiliently mounted by means of a spring on a binding part. Therefore, if the binding part is moved towards the stationary part of the magnetic circuit, the pulling force of the permanent magnet acts against the force of the spring. However, if the binding part is moved away from the stationary part of the magnetic circuit, then the movable part of the magnetic circuit first continues to adhere to the stationary part of the magnetic circuit up until a point in time when, due to the continued movement of the movable binding part away from the stationary part, the spring force becomes so large that the movable part is suddenly removed from the stationary part of the magnetic circuit, so that again because of the abrupt and fast movement a high induction voltage is generated in the pick-up coil.

In accordance with another embodiment of the invention, the generated induction voltages are electronically processed and are eventually applied to the electronic switch to control its operation.

According to still another embodiment of the invention, it is possible to generate by means of the magnetic circuit only the voltage which is necessary for creating the connection between the battery and the load. On the other hand, the voltage necessary for opening the electronic circuit is generated within the electronic circuit or part of the ski-binding at a time when a release operation occurs.

Yet another embodiment of the invention provides that the induction voltage generated during both the opening and the closing of the magnetic circuit, is used for connecting and disconnecting the battery and the load.

Additional objects, advantages and essential features of the invention may be derived from the following description of embodiments of the invention in connection with the drawing, and from the appended claims. Turning to the drawing:

FIG. 4 shows an embodiment of an electronic processing circuit according to the invention for generating an electrical control signal for providing the connection between a battery and a load in an electronic ski-binding;

FIG. 5 shows another embodiment of an electronic processing circuit according to the invention for generating an electronic control signal for providing an electrical control signal so as to connect or disconnect a battery and a load;

FIGS. 6 and 7 show diagrams of voltage signals induced in a pick-up coil;

Figure 1:
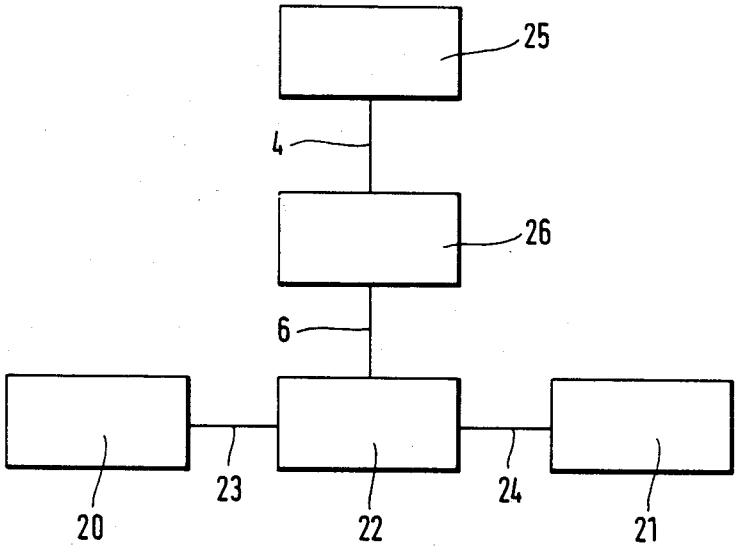
FIG. 1 is a block diagram of circuitry for generating a control signal for an electronic switch.

FIG. 1 is a block diagram of a circuit used for connecting a battery 20 with a load 21. The load 21 preferably is the electronic portion or circuit of an electronic ski-binding. Typically, an electronic ski-binding comprises besides the electronic portion a mechanical portion. Electronic ski-bindings of this type are known from U.S. Pat. No. 4,291,894.

In accordance with the invention, an electronic switch 22 is provided to connect the electronic circuit or electronic portion 21 with battery 20. In the following description, the electronic circuit portion of the ski-binding will be referred to as load 21. The battery 20 is connected via one or a plurality of conduits 23 with the electronic switch 22. The electronic switch 22 in turn is connected by means of one or a plurality of conduits 24 with load 21.

The electronic switch 22 preferably is a semiconductor switch. For example, the electronic switch can be a transistor.

The electronic switch 22 is operated, i.e., switched on and switched off, respectively, by means of an apparatus for generating control signals or signal generator 25, and an electronic processing circuit 26. The signal generator 25 is connected with said electronic processing circuit 26 via conduit 4 and the electronic processing circuit 26 is connected with the electronic switch 22 via conduit 6. The above-mentioned switch-on and switch-off operation of the switch 22 is effected for an electronic ski-binding in a situation where the skier steps into the binding and steps out of the binding, respectively. The step-in and step-out operation, respectively, is used for activating the signal generator 25.

The present invention employs electronic switch 22 and relates according to one aspect to a preferred design of the signal generator and relates according to another aspect to the design of the electronic processing circuit 26.

Figure 2:
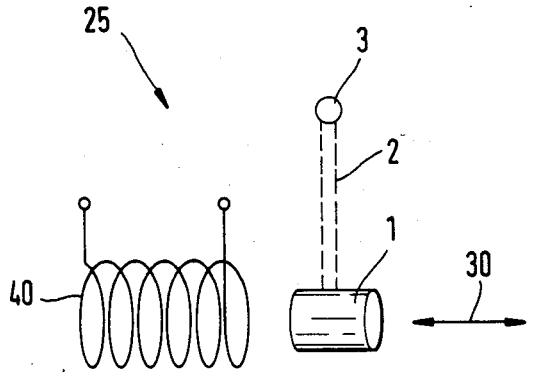
FIG. 2 is a schematic representation of the operation of a part of a preferred embodiment of the invention for creating an electrical control signal.

FIG. 2 discloses schematically the signal generator 25 as using a pick-up coil 40 as well as a permanent magnet 1. Preferably, magnet 1 is movably mounted with respect to the pick-up coil 40, as is shown by arrow 30. For instance, the magnet may be suspended at pivot point 3 by means of an arm 2.

The magnet 1 is, for instance, mounted at a sole holder of the ski-binding or at any other part of the ski-binding which will be moved when the step-in operation into the ski-binding occurs. On the other hand, pick-up coil 40 is mounted in a stationary manner in the binding. For instance, the pick-up coil 40 can be mounted on the binding plate. As is known, the movement of the magnet 1 with respect to the pick-up coil 40 will cause the induction of a voltage in pick-up coil 40. In accordance with the invention, the induced voltage is used for controlling the operation of the electronic switch 22. Preferably, this voltage is supplied via conduit 4 to the electronic processing circuit 26. After the appropriate processing has occurred, the processed voltage is used to actuate the electronic switch 22.

In accordance with another embodiment of the invention, the pick-up coil 40 is movably mounted while the permanent magnet is stationary. It is, however, preferred to arrange the pick-up coil 40 in a stationary manner and to movably mount magnet 1.

Figure 3:
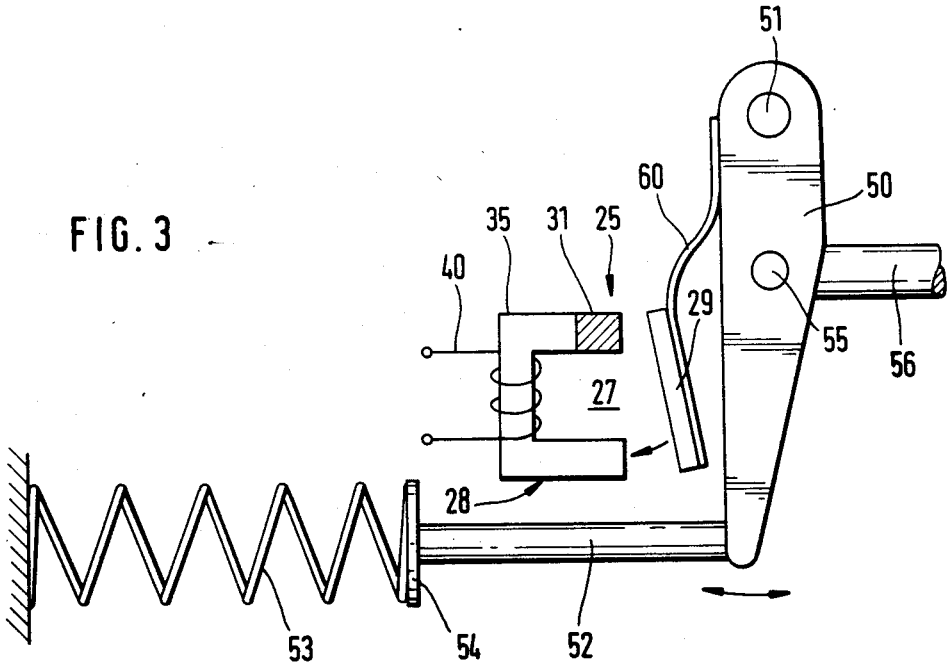
FIG. 3 shows in schematic form parts of the mechanical part of an electronic ski-binding together with components of a preferred form of the invention for generating an electrical control signal.

FIG. 3 discloses a preferred embodiment of the invention according to which the signal generator 25 comprises a magnetic circuit 27. The magnetic circuit 27 comprises a stationary part 28 and a movable part 29. The stationary part supports the pick-up coil 40. Further, magnetic circuit 27 comprises a permanent magnet 31.

The permanent magnet 31 as shown in the embodiment of FIG. 3 is a member of the stationary part 28. Alternatively, the permanent magnet could be the movable part 29 of the magnetic circuit. The embodiment of FIG. 3, however, discloses the movable part 29 as being the magnetic yoke consisting of a soft magnetic material. The stationary part 28 is a U-shaped magnetic member 35, with the permanent magnet 31 being mounted thereon. The U-shaped arrangement of FIG. 3 cooperates with yoke 29. The pick-up coil 40 is wound upon the connecting member of the two legs of the stationary part 28 and provides the induced voltage signals via conduit 4, as is shown in FIG. 1, to the electronic processing circuit 26.

According to the embodiment of FIG. 3, the stationary member 28 of the magnetic circuit 27 is located adjacent to a release lever 50 of the mechanical part of the electronic ski-binding. The release lever 50 is pivotally mounted at 51 and abuts with its opposite end at an end of a release pin 52. The release pin 52 is in contact with a spring 53 via a plate 54. The opposite end of the spring is supported by a fixed member of the binding. The release lever 50 is connected at 55 with one end of an actuating pin 56 which is adapted to actuate a locking member of the heel holding means of the ski-binding, i.e., to open the ski-binding in case a release situation occurs. For details, see German Offenlegungsschrift No. 31 32 465.

FIG. 3 discloses the embodiment in the condition of release of the ski-binding. This means that the pin 56 has already opened the locking member of the heel holding means. This opening operation is caused by the force of the release spring 53, a force which is transmitted via the release pin 52.

The release lever 50 is a member or part of the ski-binding which is movable when stepping into the binding and when stepping out of the binding. Mounted on release lever 50 is the previously mentioned movable part 29 of the magnetic circuit. In the represented embodiment, the movable part 29 is the yoke of the magnetic circuit. The movable part 29 is mounted by means of a resilient or elastic element wiich, in this embodiment, is a spring 60, specifically a leaf spring.

The following is a description of the operation of the signal generator 25 of FIG. 3 when the skier steps into the ski-binding. The step-in operation into the ski-binding causes the release lever 50 to be pivoted leftwardly in FIG. 3 while at the same time the release spring 53 is tensioned. Locking means (not shown) hold the release lever 50 in its tensioned position. Simultaneously with the movement of the release lever 50 towards the left, the movable part 29 comes closer to the two legs of the U-shaped stationary part 28. As soon as there is a sufficiently small distance between the movable part 29 and the stationary part 28, the movable part 29 is quickly pulled onto the legs due to the force created by the permanent magnet 31. This movement is made possible by the presence of leaf spring 60. Due to the fast closing operation of the magnetic circuit 27, a voltage is induced in the pick-up coil 40, as is shown in FIG. 6. This induced voltage is supplied to the electronic processing circuit 26 via circuit 4.

When a release of the ski-binding takes place or when the skier intentionally steps out of the binding, again a high inductional voltage is generated in the pick-up coil 40 of the embodiment of FIG. 3. Again, this voltage is generated due to the fast change of the magnetic flux in the magnetic circuit 27. This will be explained in some detail. When the release operation takes place, the release lever 50 moves (see FIG. 3) towards the right and initially the movable part 29 of the magnetic circuit continues to adhere to the U legs of the stationary part 28. Only after the leaf spring 60 is tensioned to such a degree that the holding force of the permanent magnet 31 together with the stationary part 28 is no longer sufficient to hold the movable part 29 any longer on the legs, due to the movement toward the right of the release lever 50, does the movable part 29 suddenly pull away, and again the desired high induction voltage (or induced voltage signal) is generated in pick-up coil 40. This time the voltage signal is of opposite polarity with respect to the voltage signal generated when stepping into the binding. In this context, see also the description of FIG. 6 below.

In the embodiment of FIG. 3, the resilient or elastic element for mounting the movable part 29 on a movable part of the binding (the movable part of the binding is here the release lever 50) is a leaf spring 60. However, other resilient elements might be used, such as a coil spring. It is also possible to provide a different design of the magnetic circuit 27 as will be explained below when describing the arrangement of FIG. 10.

FIG. 4 shows a first embodiment of an electronic processing circuit 26. As is shown in FIG. 4, the input of the processing circuit 26 is connected via a conduit 4 to the pick-up coil 40. The processed control signal is delivered via conduit 6 to the electronic switch 22. Circuit 26 is employed to make use of the voltage signal generated when the skier steps into the ski-binding. The voltage signal induced in the pick-up coil 40, when the skier leaves the binding, is not used in this embodiment. The reset for this embodiment occurs by means of a signal applied to the reset input of circuit 26; this signal is supplied by the electronic part of the binding.

FIG. 6 shows schematically for the circuit of FIG. 4, the wave forms of the voltages induced in the pick-up coil 40. The positive going voltage peak 87 occurs when the magnetic circuit 27 is closed (or opened), while the negative going voltage peak 88 occurs when the magnetic circuit 27 opens (or is closed).

FIG. 7 shows the effect of a diode $D_z$ of FIG. 4. The diode $D_z$ provides protection for the clock-input C with respect to high voltages. The D-input of the D-flip-flop is supplied all the time with the logic level "1" (i.e., $+V_B$). In case that the binding is not in use, the Q-output is at the logic level "0". This is due to the "reset"-pulse at the reset input which was delivered on the occasion of the occurrence of the last step-out event of the skier. As soon as an induced voltage signal supplied by pick-up coil 40 and limited by diode $D_z$ is applied to the C-input, the D-flip-flop switches, i.e., at the Q-output the logic level "1" appears. This logic level "1" remains at the output even if the induced voltage signal has disappeared. The induced negative voltage signal is cut off by means of the diode $D_z$. This means that the electronic switch 22 is transferred via conduit 6 into its on-condition. The switch 22 remains in said on-condition as long as the Q-output is at the logic level of "1". As soon as the ski-binding is released or the skier intends to step out of the binding, the electronic part of the ski-binding supplies a signal to the reset input of the D-flip-flop so that at the Q-output, the logic level "0" appears, i.e., the electronic switch 22 goes into its off-condition which means that the battery 20 is disconnected.

FIG. 5 shows a different embodiment of an electronic processing circuit 260. The processing circuit 260 is designed such that the induced voltage signal occurring for closing as well as the opening operation of the magnetic circuit 27 is used. The processing circuit 260 again supplies on conduit 6 the condition control signal for the electronic switch 22.

The processing circuit 260 is provided with input terminals 80,82 between which the pick-up coil 40 is arranged. Terminal 82 is connected to the input of a Schmitt trigger $A_1$, the output 81 of which is connected to conduit 6. At the same time the output 81 is connected via a resistor $R_3$ with terminal 80. Also, a resistor $R_2$ is connected with one side to terminal 80 and with the other side to ground. A resistor $R_1$ is also connected with terminal 80 and is connected, on the other hand, via conduit 83 with the voltage supply $+V_B$ of an amplifier $A_1$. A diode $D_2$ is connected with its anode to ground and with its cathode to terminal 82. Another diode $D_1$ is connected with its anode to terminal 82 and with its cathode to conduit 83. As was true for circuit 26 of FIG. 4, the circuit 260 has to supply for the operation of the electronic switch 22 certain voltage levels via conduits 6. The switch-on operation and the switch-off operation, respectively, of the electronic switch 22 are effected by a high voltage level (logic level "1") or by a low level (logic level "0"), respectively. It is also possible to use a low level for the switch-on operation and a high level for the switch-off operation.

For the circuit 260 the resistors $R_1$ and $R_2$ are chosen such that without considering the influence of resistor $R_3$, the voltage at terminal 80 should correspond in substance to the switching threshold of the Schmitt trigger $A_1$. For instance, the switching threshold can be at one half of the operating voltage $+V_B$.

Figure 8:
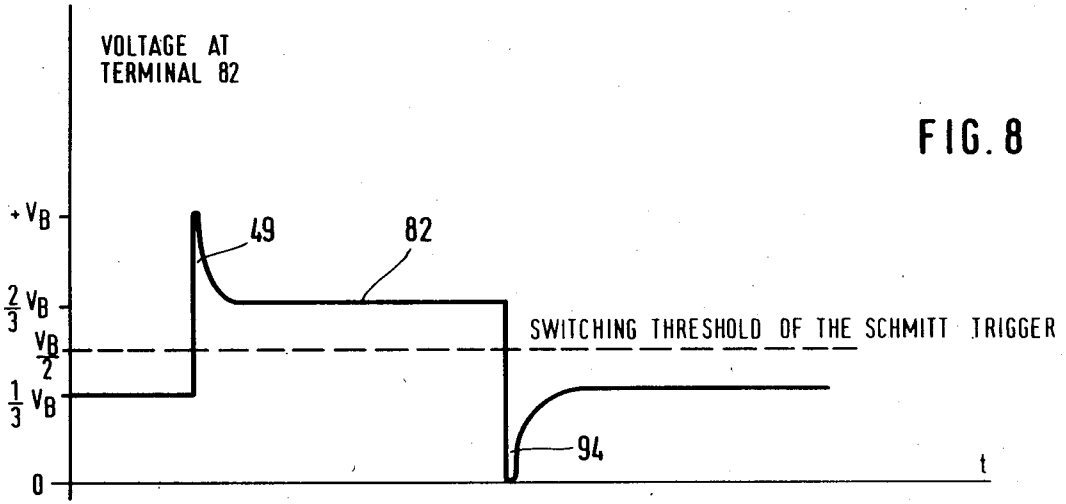
FIGS. 8 and 9 show the ideal wave shapes as they can occur when operating the circuit of FIG. 5.
Figure 9:
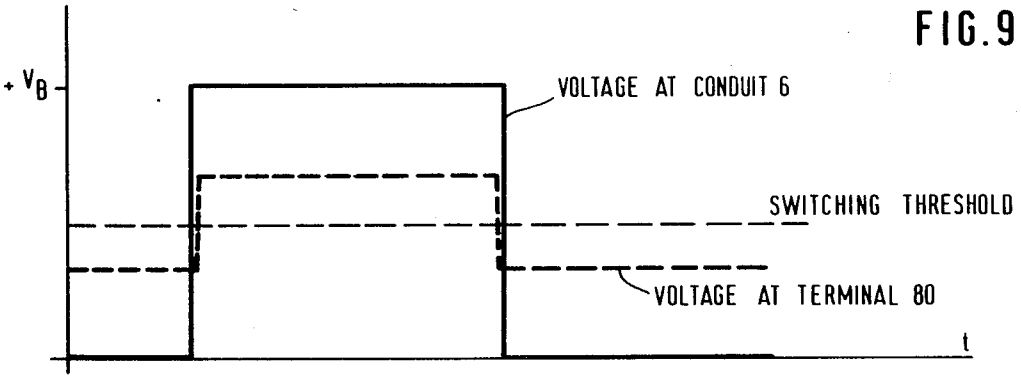

If one assumes—see FIGS. 8 and 9—that the output 81 initially is "0", then at the terminal 80 a voltage occurs which, depending on the value of resistor $R_3$, is more or less below the switching threshold. (If $R_1=R_2=R_3$ terminal 80 is on a voltage of $(+V_B/3)$).

If the pick-up coil 40 supplies a positive voltage signal (voltage pulse 49)—this voltage signal naturally has to exceed the switching threshold—then the Schmitt trigger $A_1$ switches and supplies at its output 81 a "1" logic level. This means that the voltage at terminal 80 is raised beyond the switching threshold (for instance up to $(+2V_B/3)$).

Even after the voltage pulse 49 has declined, the output voltage of the Schmitt trigger $A_1$ at the output terminal 81 remains at "1". In case another positive voltage pulse should arrive, this does not change the condition of the Schmitt trigger $A_1$.

However, as soon as the pick-up coil 40 supplies a sufficiently negative voltage pulse 94 (which indicates the step-out operation), then the switching threshold is undercut and the Schmitt trigger $A_1$ switches to its "0" condition. The consequence is that the electric switch 22 is switched into its rest position. The way the circuit 260 functions is thus shown in FIGS. 8 and 9.

Figure 10:
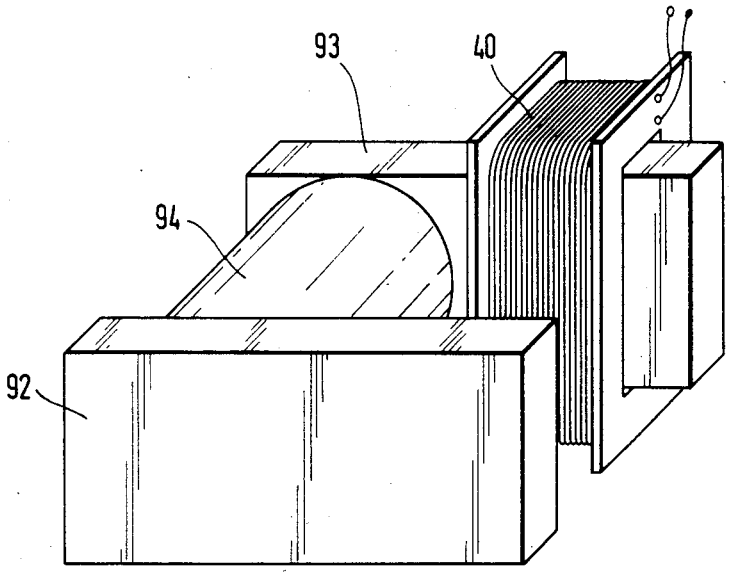
FIG. 10 is a preferred embodiment of the stationary part of the magnetic circuit according to the invention.

FIG. 10 discloses a preferred embodiment of the stationary part 28 of the magnetic circuit. In accordance with the invention, a permanent magnet 94 is arranged between two legs 92, 93 made of a soft iron material. The legs are of a rectangular cross-sectional arrangement. At least on one of said soft iron legs, i.e., leg 93, the pick-up coil 40 is wound.

The invention has been described in detail with particular reference to its preferred embodiments, but it should be understood that variations and modifications within the spirit and scope of the invention may occur to those skilled in the art to which the invention pertains.

I claim:

1. An electronic ski binding having a release mechanism for releasing a ski boot from the binding in response to electrical release signals reflective of the application of forces of a predeterined value applied to the binding, said binding comprising:

an electrical load for generating and processing electrical signals reflective of the value of forces applied to the binding and for generating the electrical release signals; an electrical energy source connectable to the electrical load;

an electronic switch actuable to an on condition for connecting the electrical source to the electrical load in response to control signals;

a movable part which is movable in response to a ski boot entering the binding;

control signal generating means for generating control signals for actuating the electronic switch to the on condition, said control generating means comprising induction coil means and magnet means; and processing means electrically connected to the electronic switch, one of said induction coil means and said magnet means being mounted on said movable part for movement relative to the other of said coil means and said magnet means in response to the entry of the ski boot into the binding for inducing an electrical control signal in said induction coil means for actuating said electronic switch to the on condition, and said processing means generating an output signal to the electronic switch for maintaining said electronic switch in the on condition in response to the generation of said control signals.

2. The invention according to claim 1 wherein said magnet means induces an electrical control signal of one polarity in said induction coil means in response to a skier stepping out of the binding to de-actuate said electronic switch.

3. The invention according to claim 1 wherein said electronic ski binding has a fixed part, said induction coil mean is mounted on said fixed part and said magnet means is mounted on said movable part.

4. The invention according to claim 3 wherein said fixed part comprises a permanent magnet and a core member adjacent said permanent magnet, said coil being wound about said core member, and said movable part is movable between a temporarily fixed first position under the influence of said permanent magnet and a second position away from said permanent magnet.

5. The invention according to claim 4 wherein said movable part moves between said first and second positions in response to a skier stepping into said binding to cause said magnet means to induce the electrical signal in said coil means.

6. The invention according to claim 4 wherein said movable part comprises a movable step-in member movable in response to a skier stepping into the binding, said magnet means being attached to said movable step-in member and said movable step-in member moving to said first position when a skier steps into the binding.

7. The invention according to claim 6 and further comprising resilient means for attaching said magnet means to said movable step-in member.

8. The invention according to claim 6 wherein said movable step-in member comprises a release member for releasing the ski binding from a latched condition.

9. The invention according to claim 1 wherein said electronic processing means includes:

flip-flop means having a clock input connected to the output of said signal generating means, a first input and means for supplying a high logic level signal to said first input, an output having alternate on logic level and off logic level output signals and a reset input part;

diode means connected to said clock input;

reset signal generating means generating signals to reset the output of said flip-flop means to the off logic level signal;

said signal generating means generating input signals to said clock input to effect the generation of an on logic level signal by the output of said flip-flop means, and said reset signal generating means generating signals to reset said flip-flop means in response to the release of the ski binding.

10. The invention according to claim 1 wherein said electronic processing means includes:

trigger signal generating means having first and second input parts and an output part, the first input part being connected to the output of said signal generating means, the second input being connected to the input of said signal generating means and the output of said trigger signal generating means being connected to said electronic switch and to the input of said signal generating means, first diode means having an anode connected to the first and second inputs of said trigger signal generating means, and second diode means having an anode connected to ground and a cathode connected to the first input of said trigger signal generating means;

said trigger signal generating means having a switching threshold and generating and maintaining an output signal to actuate said electronic switch when signal generating means generates a signal of one polarity exceeding said switching threshold, and said trigger signal generating means generating an output signal to terminate the actuation of said electronic switch when said signal generating means generates a signal of the opposite polarity below said switching threshold.

* * * * *